United States Patent [19]

Winter

[11] Patent Number: 4,899,472

[45] **Date of Patent: * Feb. 13, 1990**

[54] SNOW PLOW GUARDS COMPRISING PLIANT POLYMER

[76] Inventor: Kent L. Winter, P.O. Box 463, 38255 Ridge Rd., Willoughby, Ohio 44094

[ * ] Notice: The portion of the term of this patent subsequent to May 30, 2006 has been disclaimed.

[21] Appl. No.: 323,666

[22] Filed: Mar. 15, 1989

Related U.S. Application Data

[63] Continuation-in-part of Ser. No. 154,911, Feb. 11, 1988, Pat. No. 4,833,801.

[51] Int. Cl.[4] ..... E01H 5/06; B32B 9/00

[52] U.S. Cl. ..... 37/270; 37/264; 37/141 R; 428/465

[58] Field of Search ..... 37/270, 141 R, 141 T, 37/214, 218; 172/772, 772.5, 719, 701.2; 428/458, 462, 465

[56] References Cited

U.S. PATENT DOCUMENTS

| | | | |
|---|---|---|---|
| Re. 31,045 | 10/1982 | Essell et al. | 37/281 |
| 298,088 | 5/1884 | Holden et al. | 37/198 |
| 2,061,585 | 11/1936 | Meyer | 37/270 X |
| 2,148,925 | 2/1939 | Bochy | 172/745 |
| 2,718,162 | 9/1955 | Smith | 172/719 |
| 2,965,989 | 12/1960 | Hibbard | 172/701.2 |
| 3,197,895 | 8/1965 | Cooke | 37/141 R X |
| 3,281,972 | 11/1966 | Kerestes | 172/719 X |
| 3,638,736 | 2/1972 | Hahn | 37/141 R |
| 3,888,027 | 6/1975 | Toews | 37/141 R |
| 4,007,550 | 2/1977 | Stepe | 37/141 T |
| 4,047,312 | 9/1977 | Stepe | 37/141 R |
| 4,275,514 | 6/1981 | Maura | 37/281 |
| 4,290,214 | 9/1981 | Stepe | 37/141 T |
| 4,356,645 | 11/1982 | Hine et al. | 37/281 |
| 4,357,766 | 11/1982 | Croteau et al. | 37/281 |
| 4,489,123 | 12/1984 | Schijue et al. | 428/458 X |
| 4,596,734 | 6/1986 | Kramer | 428/462 X |
| 4,667,426 | 5/1987 | Howard et al. | 37/232 |
| 4,715,450 | 12/1987 | Hallissy et al. | 172/701.3 |

FOREIGN PATENT DOCUMENTS

| | | | |
|---|---|---|---|
| 518818 | 2/1931 | Fed. Rep. of Germany | 172/719 |
| 1080937 | 4/1960 | Fed. Rep. of Germany | 37/141 R |

*Primary Examiner*—Dennis L. Taylor
*Assistant Examiner*—Arlen L. Olsen
*Attorney, Agent, or Firm*—Watts, Hoffmann, Fisher & Heinke Co.

[57] ABSTRACT

Guards, usually used in pairs as replaceable attachments to snow plow blade, are shown. At least one of the pair consists essentially of a panel portion with an integral curb feeler extending therefrom and supported thereby that sweeps around a blade end and reaches rearwardly; the curb feeler extension on its mate is optional. The guards comprise deformable polymer. Advantageously the polymer is laminated with a lamina of a hard metal such as steel that is fitted with an especially abrasion-resistant bottom edge. An assembly of the laminae typically is held together with bolts to the plow, and the laminae can be adhesively bonded together also, if desired.

12 Claims, 3 Drawing Sheets

SNOW PLOW GUARDS COMPRISING PLIANT POLYMER

REFERENCE TO A RELATED APPLICATION

This patent application is a continuation-in-part of my copending application Ser. No. 07/154,911, now U.S. Pat. No. 4,833,801, filed on Feb. 11, 1988, and entitled *Snow Plow Guards* issued May 30, 1989.

TECHNICAL FIELD

This application relates to snow plows and more specifically to guards for the cutting edge, i.e. the blade, thereof.

BACKGROUND ART

Usually the heavy steel cutting edge (blade) is expendable and is removably attached, e.g., with bolts, to the bottom of the plow moldboard. It scrapes along the pavement and can wear out in 8 to 10 hours. The wear often is uneven, and blades (cutting edges) sometimes break during plowing. Plows also often encounter substantial curb wear which can require major rebuilding. All this maintenance is costly.

The present invention is directed to increasing snow plow blade life substantially, reducing blade breakage, protecting blade ends from curb wear, protecting the moldboards of snow plows, and generally cutting downtime for plow maintenance.

Its advantages over prior virtually all-metal snow plow guard proposals include an ability to be made somewhat lower in weight without an inordinate sacrifice in efficacy, an ability to be made to yield slightly to certain expected impacts rather than meeting them rigidly with potentially greater wear and tear, an ability to be made to bend and return more readily to near original shape from other impacts, and an ability to unite extreme toughness and resilience with hardness in the guard structure.

BROAD STATEMENT OF THE INVENTION

One aspect of the invention is a guard adapted for replaceable attachment to the expendable blade of a snow plow at an outer end of the blade, the guard consisting essentially of two portions, specifically:

a panel portion that conforms generally to the front part of said outer end of the blade; and a curb feeler portion that is an integral extension of at least part of the panel portion, supported by the panel portion and formed to project to the side of and sweep rearwardly around of said outer end of the blade, the guard comprising flexible polymer.

Another aspect of the invention is a set of guards, one for each end of a snow plow blade, at least one of the guards being like the guard defined above, the other one optionally lacking a curb feeler portion.

Still another aspect of this invention is a snow plow moldboard having attached thereto an expendable blade and a set of the guards defined above.

DEFINITIONS

Figure 1:
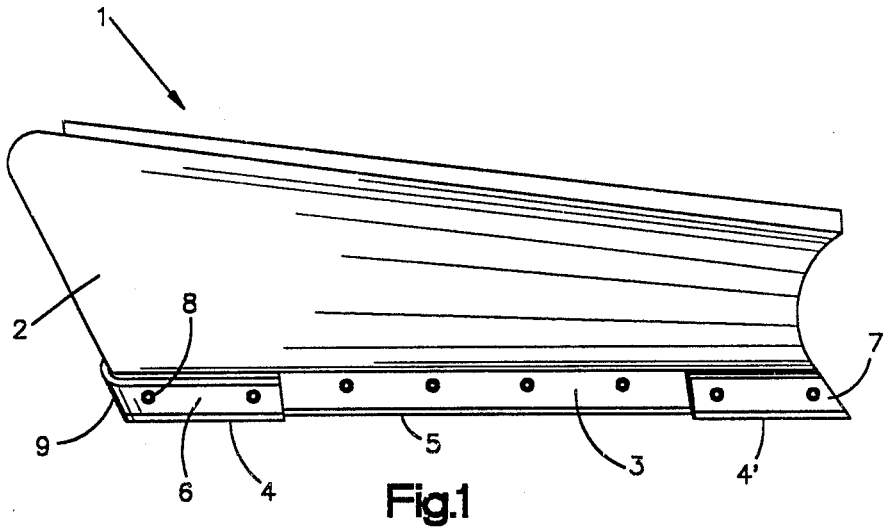
FIG. 1 is an isometric view of the inventive plow moldboard with the instant plow guards.

A "polymer" for the guards here is meant to include natural and synthetic rubbers, copolymers, interpolymers, homopolymers, polymer alloys, addition and condensation polymers such as polyolefins, polyesters, polyamides and aramids, and compositions where the polymer is the continuous phase, including those containing plasticizers and antioxidants and where the composition is reenforced internally with one or more plies of fabric, strands of cord or metal wire, carbon black, zinc oxide and other conventional agents and fillers, the exposed surface of the polymer optionally being studded with wear-resistant, eg. metal, studs like some snow tires. The polymer composition should be flexible when it is in $\frac{3}{8}$ inch thick, 6"×18" sheet form. Advantageously, many of the polymers are somewhat elastomeric, like an automobile tire carcass. The polymer composition should not become brittle, but remain flexible, at subzero Fahrenheit temperatures likely to be encountered.

"Steel" for the guards here is meant to include mild carbon steels, heat hardenable steels, ultraservice steels, a maraging steel, armor plate, and cast ductile iron including austinized types, which really are ferrous metals rather than a steel.

BEST MODES FOR CARRYING OUT THE INVENTION

A diagonally-oriented, truck front-mountable snow plow is indicated broadly by arrow 1. Steel moldboard 2 has at its base one-inch thick steel blade 3 fitted along its 10-foot base. On the leading (right) side of the blade 3 is right guard 7; on the trailing (left) side is left guard 6. The guards 6 and 7 and the blade 3 are attached to the moldboard 2 by standard $\frac{5}{8}$" bolts 8. The bolt holes of the guards are in register with those of blade 3 so as to have bolting attachment of the guards with some of the same bolts as hold the blade to the moldboard.

The essentially flat or panel portion of each guard is 12 inches long; 8 inches high, and is about $1\frac{1}{2}$ inches thick, thickening somewhat more than this towards and at the outer end. The curb feeler 9 on the left guard 6 wraps around the trailing edge of the blade; right guard 7 has no curb feeler.

The bottom edge 4 of the panel portion of guard 6 and the bottom edge 4' of guard 7, as well as the entire bottom edge 5 of the blade 3, have on them a layer of weld metal to make a $\frac{5}{8}$ inch deep buildup. The weld is across the full bottom thicknesses of the guard steel 14 and the steel blade 3. To create a back rake angle on the weld buildups on the lower margins of the guards, there is a single ½ inch wide bead along the front edges of the welds. The weld deposits 4 and 4' have the following analysis (balance iron):

| C | Cr | Mo | Si | Mn |
|---|---|---|---|---|
| x100 | x100 | x100 | x100 | x100 |
| 2.60 | 12.00 | 0.62 | 1.37 | 0.77 |
| Hardness/Rc 55-60 | | | | |

Typically conventional hard-facing or wear-facing weldments are used for these abrasion-resisting deposits. So-called chrome carbide steels are the most common, e.g., Stoody Company No. 121, although vanadium carbide (Stoody No. 134) and tungsten carbide ones also can be used very effectively.

These weldments are reconstitutable in the sense that they can be repaired or replaced by redeposition of more of them by welding. Alternatively, one or more strips of material resembling that deposited could be welded on or otherwise conventionally attached. However, it is likely that such practice would be more expensive than the weldments of FIG. 1.

Figure 2:
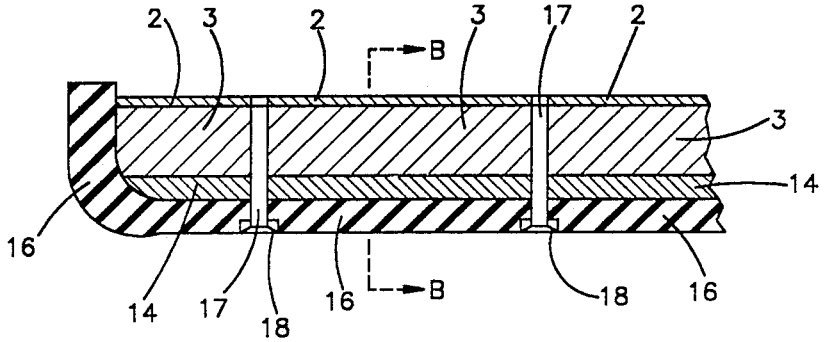
FIG. 2 is a fragmentary horizontal cross section view through the bolt holes of attached left guard 6 of FIG. 1, with the bolts removed for simplicity.

In FIG. 2 bolts (not shown) that pass through bolt holes 17 hold the laminated left guard (item 6 of FIG. 1) to the blade 3 and moldboard 2. The guard is made of nylon fabric-reenforced, carbon-black containing natural rubber as the outer lamina 16, ¾ inch thick, and armor plate steel 14, ¾ inch thick as the inner one. These laminae are not adhesively united to each other but can be, e.g., by using an epoxy resin adhesive, or a proprietary bonding agent such as Chemlok #218 (manufactured by the Lord Corporation, Erie, Pa.) or a Pliobond type (made by the Goodyear Tire and Rubber Company of Akron, Ohio). It is normal practice to clean the metal surface for accepting the bonding agent, and many of the bonds require warming to develop their strongest adherence.

Lock washers 18 embedded in the front face of lamina 16 hold the heads of the assembly bolts in place. In place of the several plies of nylon fabric reenforcement the polymer (outer) lamina can have internally a mesh or cords of aramid fiber (Kevlar, a trademark of E. I. duPont de Nemours & Co.) or strong polyethylene (Spectra, a trademark of Allied-Signal, Inc.), or even steel wire mesh or cords.

Figure 3:
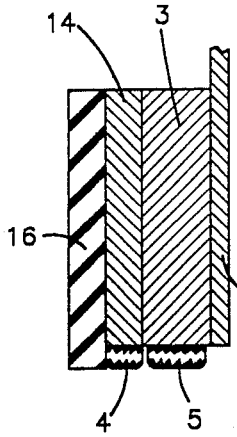
FIG. 3 is a fragmentary vertical cross sectional elevation taken through plane B—B of FIG. 2.

In FIG. 3 the outer lamina 16 and inner one 14 of FIG. 2 can be seen in vertical cross section, together with the wear weldments 4 and 5 on the bottoms of steel lamina 14 and blade 3, respectively. The armor plate of lamina 14 has the following analysis (balance iron):

| C | Mn | P | S | Si | Cr | B | Hardness |
|---|---|---|---|---|---|---|---|
| x100 | x100 | x1000 | x1000 | x100 | x100 | x100 | Bhn |
| 16 | 140 | 16 | 16 | 525 | 26 | 0.4 | 363/401 |

Figure 4:
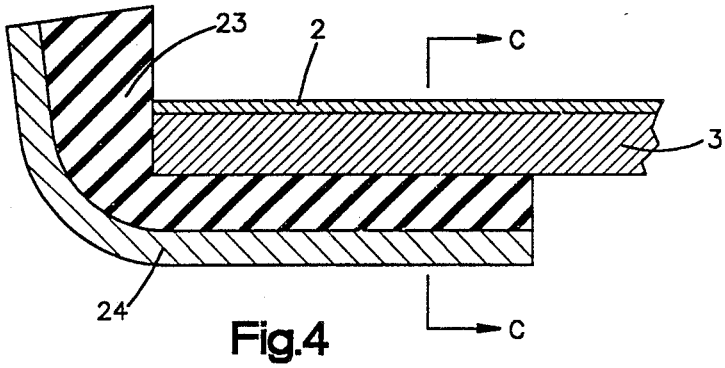
FIG. 4 is a fragmentary horizontal cross section view taken below the bolt holes of an attached left guard mounted like left guard 6 in FIG. 1, except that the outer lamina of the guard is metal.

FIG. 4 shows a composite left guard of the same materials as the guard of FIG. 2, but with the outer ½ inch thick lamina 24 being of armor plate (thickened slightly more at the corner) and the inner one 23 of the compounded rubber described in connection with FIG. 2. The panel portion of this polymer lamina 23 is 1 inch thick.

Figure 5:
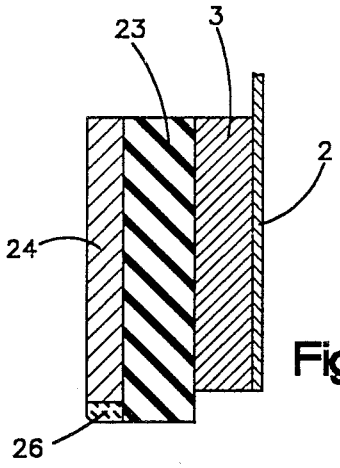
FIG. 5 is a fragmentary vertical cross sectional elevation taken through plane C—C of FIG. 4.

FIG. 5 shows the guard of FIG. 4 in vertical cross section. Outer lamina 24 has an abrasion-resistant weldment 26 on its bottom, and it is backed up by the inner polymeric lamina 23, the blade 3 and the moldboard 2.

Figure 6:
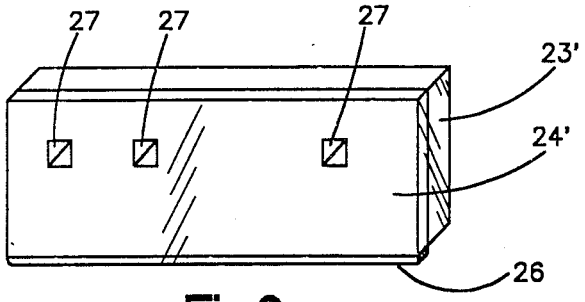
FIG. 6 is a perspective view of a right guard without a curb feeler portion, this guard to be one of a set with the one depicted in FIG. 4.

FIG. 6 shows the right guard (having no curb feeler portion) corresponding to the left guard depicted in FIG. 4. The outer steel lamina 24' and inner polymeric lamina 23' are perforated by three bolt head-receiving holes 27 (as is the case with corresponding left guard also), and the panel portions of each are 20 inches long and 8 inches high. A guard this long generally has a longer life than a shorter guard that is otherwise of the same construction.

Figure 7:
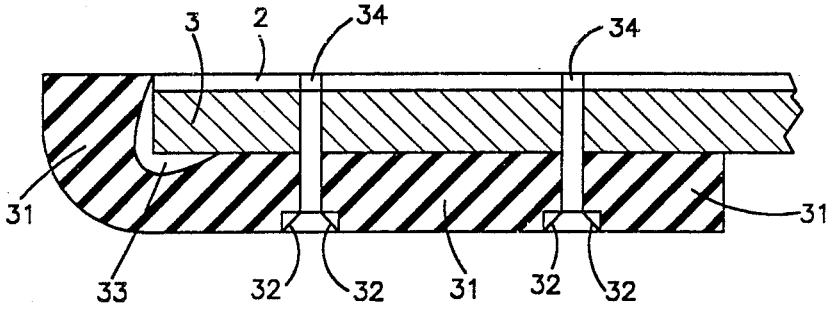
FIG. 7 shows a fragmentary horizontal cross sectional view of an attached left guard made of a solid, elastomeric compounded, reenforced rubber much like a tire carcass, the attaching bolts being omitted for simplicity.

The horizontal cross section of a left guard of a solid fabric-reenforced compounded rubber like that used in connection with FIG. 2 is depicted in FIG. 7. The panel part of guard 3 is 8 inch high and 12 inch long. It is held to blade 3 and moldboard 2 by bolts (not shown) that enter bolt holes 34 and seat into lock washers 32 on the face.

The main part of the panel portion and the rear of the curb feeler portion are 1¼ inch thick. Between the end of the blade 3 and the inside corner of the guard 31 is a deformable gap 33. Pressure from the front, on the corner, or a dragging pressure from the side of guard 31 tends to deform the gap 33 and flatten the guard with concomitant slipping backward of the inner rear of the guard. When the pressure is relieved, the guard resumes its original shape substantially. Bolts, not shown, extend through bolt holes 34 and are locked by lock washers 32.

Figure 8:
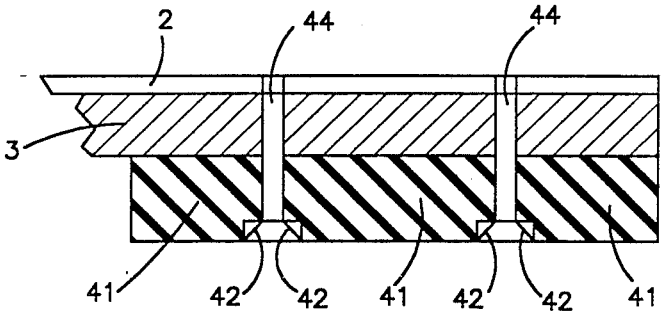
FIG. 8 is a fragmentary horizontal cross section of the right guard of a set where the other guard is that of FIG. 7.

The horizontal cross section of a right guard 41 is shown in FIG. 8. It is the mate of the guard 31 of FIG. 7, and it has no wraparound curb feeler portion nor any deformable gap at its outer end. Bolts, not shown, extend through bolt holes 44 and are locked by lock washers 42.

While the curb feeler has been shown for only one side of the plow of the figures, both guards can have them. Also more than two laminae can be used, say, a metal one sandwiched between a pair of polymeric ones or vice-versa, and an individual lamina such the outermost one can be replaced while retaining the others if the laminae are not bonded together. While the moldboard and blade has been shown with diagonal orientation, clearly they could be squarely transverse to travel, vee-shaped or of other conventional orientation.

The very strong modern polymers such as some aramids and certain polyethylenes can be used particularly well in laminae that back up hard steel laminae, and wear-resistant fillers such as emery grit can be compounded into synthetic rubbers and other polymeric laminae for improved abrasion resistance, especially at the outward exposed surfaces of same.

Conceivably, one could embed into an outer polymeric lamina the shanks of a partial covering of hard-faced ceramic, cermet, and/or metal button-like objects, collar stud-like pieces, or even studding akin to that used in snow tires but being more rounded so as not to catch onto things. These facings could have one or more anchoring elements on their shanks, e.g., like those of a collar button, for anchoring them into a polymer lamina, have special adhesion onto or into their polymeric matrix, and/or even be joined flexibly together at their sides (edges) in the manner of the units of small ceramic tile assemblies used for floor and wall covering, such assemblies being adapted for adhering in place, then grouting in. Vinyl plastisols and organsols are good for making appropriate polymer lamina and flexible connections for such guard facings.

Many other modifications and variations of the invention will be apparent to those skilled in the art in the light of the foregoing disclosure and drawings. Therefore, it is to be understood that, within the scope of the appended claims, the invention can be practiced otherwise than has specifically been shown and described.

I claim:

1. A guard adapted for attachment to the front of an outer side end of the expendable blade disposed across the moldboard of a snow plow, the guard being attachable for extending the service life of the blade and including:

a panel portion that conforms generally to the front part of said outer end of the blade; and a curb feeler portion comprising a flexible polymer, the curb feeler portion being integral with at least part of the panel portion and supported thereby to project to the side of and sweep rearwardly around said outer end of the blade.

2. The guard of claim 1 wherein the curb feeler portion is shaped to make a deformable gap at the end of the blade.

3. The guard of claim 1 wherein the polymer is internally reenforced with cords, wire, fabric and/or particulate solids.

4. The guard of claim 1 wherein both the panel portion and the blade to which it is to be attached are perforated for fastening, the resulting perforations of the panel portion being in register with the outer ones of said blade, and the guard is about the height of the blade and is about one to two feet long.

5. A guard adapted for attachment to the front of an outer end of the expendable blade disposed across the moldboard of a snow plow, the guard comprising:

a panel portion that conforms generally to the front part of said outer end of the blade, the panel portion being laminated, the laminae including one lamina comprising a hard metal and one lamina comprising flexible polymer, there being a reconstitutable abrasion-resistant lower margin at the bottom of a metal lamina of the panel portion; and a curb feeler portion that is formed to project to the side of and sweep rearwardly around of said outer end of the blade, the curb feeler being an integral extension of at least one of said laminae and supported thereby.

6. The guard of claim 5 wherein at least one of the laminae comprises a ferrous metal, and it has on it as the reconstitutable lower margin of the panel portion a deposit of abrasion-resistant weld metal.

7. The guard of claim 5 wherein there are two lamina, the outer one comprising flexible polymer, the inner one comprising steel.

8. The guard of claim 5 wherein there are two lamina, the outer one comprising steel, the inner one comprising flexible polymer.

9. The guard of claim 5 wherein the polymer is reenforced internally with cords, wire, fabric and/or particulate solids.

10. A guard in accordance with claim 1, 2, 3, 4, 5, 6, 7, 8, or 9 wherein a set of two guards is provided for attachment to the opposite ends of a snow plow blade, and the curb feeler portion of one of the sets is an optional feature.

11. In a snow plow having a moldboard with an expendable blade fastened across its bottom front, the improvement for extending the service life of the blade which comprises a guard in accordance with claim 1, 2, 3, 4, 5, 6, 7, 8, or 9 wherein a set of two guards is provided for attachment to the opposite ends of the blade, and the curb feeler portion of one of the sets is an optional feature.

12. A guard adapted for attachment to the front of an outer end of the expendable blade disposed across the moldboard of a snow plow, the guard being attachable for extending the service life of the blade and consisting essentially of:

a panel portion that conforms generally to the front part of said outer end of the blade; and a curb feeler portion, both said portions comprising a pair of laminae including one lamina of steel and one lamina of flexible polymer, the curb feeler portion being an integral extension of the panel portion and supported thereby, the lower margin of the steel lamina having on it a deposit of abrasion-resistant weld metal.

* * * * *